US008297205B2

(12) United States Patent
Kauffman

(10) Patent No.: US 8,297,205 B2
(45) Date of Patent: Oct. 30, 2012

(54) BEDPOST SHELF FOR DORMITORY ROOM BED

(76) Inventor: Joanne Alice Kauffman, Laurel, MD (US)

( * ) Notice: Subject to any disclaimer, the term of this patent is extended or adjusted under 35 U.S.C. 154(b) by 0 days.

(21) Appl. No.: 12/876,239

(22) Filed: Sep. 7, 2010

(65) Prior Publication Data

US 2012/0055377 A1 Mar. 8, 2012

(51) Int. Cl.
*A47B 23/00* (2006.01)

(52) U.S. Cl. ..... 108/49; 108/152

(58) Field of Classification Search ..... 108/42, 108/49, 152, 50.11, 150, 153.1, 157.11, 157.13, 108/159, 159.11, 158.11, 43; 5/503.1, 658; 248/219.2, 218.4, 238; 211/134, 90.01, 90.02, 211/186, 119.009
See application file for complete search history.

(56) References Cited

U.S. PATENT DOCUMENTS 1,235,359 A * 7/1917 Merz ..... 108/141
2,359,895 A * 10/1944 Burton ..... 248/445
2,797,973 A * 7/1957 Culpepper ..... 108/157.11
3,170,418 A * 2/1965 Gruenstein ..... 108/101
3,306,287 A * 2/1967 Arp ..... 128/847
3,358,957 A * 12/1967 Lindenmuth ..... 248/279.1
3,721,463 A * 3/1973 Attwood et al. ..... 403/258
4,367,844 A * 1/1983 Drummond ..... 232/17
5,572,751 A * 11/1996 Brandt ..... 5/9.1
5,593,128 A * 1/1997 Odom et al. ..... 248/346.01
5,722,721 A * 3/1998 Batoff et al. ..... 297/217.1
5,752,639 A * 5/1998 Rice ..... 224/521
5,755,343 A * 5/1998 Harvey, Sr. ..... 211/90.01
5,860,534 A * 1/1999 Minneman et al. ..... 211/13.1
6,079,336 A * 6/2000 Lindstrom ..... 108/42
6,189,458 B1 * 2/2001 Rivera ..... 108/44
6,336,413 B1 * 1/2002 Ball ..... 108/44
6,748,874 B2 * 6/2004 Gawronski ..... 108/42
7,647,873 B1 * 1/2010 Elflein ..... 108/158.11
2005/0273929 A1 * 12/2005 Hennings et al. ..... 5/201

* cited by examiner

*Primary Examiner* — James O Hansen
*Assistant Examiner* — Andres F Gallego

(57) ABSTRACT

A shelf unit for attachment to the top of the bedpost of a dormitory room bed. The shelf has a bedpost interface which makes the shelf easy to install, without tools, and which will not damage the bedpost. The bedpost interface may be a pin that mates with a vertical hole located in many dormitory room bedposts, with an optional bracket to prevent the shelf from rotating about the axis of the pin. Alternatively, the bedpost interface may be a sleeve that fits snugly over the top of the bedpost.

3 Claims, 7 Drawing Sheets

BEDPOST SHELF FOR DORMITORY ROOM BED

BACKGROUND OF THE INVENTION

College dormitory rooms are typically small and have tall furniture such as dressers, combination microwave-refrigerator units, and desks abutted against beds. These items abutted to the bed are either too high to conveniently hold items that would be handy to view, use, or retrieve while lying in bed, or there simply may not be sufficient surface space remaining on these abutted items of furniture to hold said items because those surfaces are utilized to hold other items important to the dormitory room occupants. These items abutted next to the bed prohibit the use of bedside tables that might be found in a residential bedroom.

Furthermore, bedposts do not typically abut directly against the dormitory room walls because there is typically at least one of wall molding, heating, air conditioning, ventilation, and other electrical equipment protruding inward from the wall surface. The resulting gap between the bedpost and the wall caused by said items provides adequate space for a shelf to hold personal items such as, but not limited to a clock, radio, reading lamp, eyeglasses, notepad, writing instrument, remote control, mobile telephone, handheld audio player, headset, and handheld video player.

In a configuration where two beds are bunked, one above the other, the occupant of the upper bunk has no easy access to any flat surface.

It is anticipated that the instant invention will find use anywhere beds similar to those used in dormitory rooms are used: homes, camps, and military quarters.

A bedpost shelf exists, U.S. Pat. No. 6,748,874 issued to Gawronski, but it protrudes into the sleeping space above the mattress where items held on the shelf might be thrown over the edge of the shelf or the bed occupant may awaken or injure themselves if they bump into the shelf as the bed occupant tosses and turns throughout sleep.

Other bedside shelves also exists, but have the disadvantage of extending into the space adjacent to the bed. Given that some dormitory rooms are so small that other furniture abuts the bed, there is often not sufficient bed rail space to utilize this shelf and provide space for easy ingress and egress from the bed.

One feature of some dormitory beds is that they are designed to be stacked in a bunk bed configuration. Many beds designed to be bunked have vertical holes drilled into the top and bottom face of the bedpost to accept a mating pin which keeps the lower and upper bunk bedposts aligned, the latter atop of the former. This vertical hole in the top face of the bedpost can serve as the mating interface for a bed shelf if the bed is not bunked.

The advantage of the instant invention is that it occupies space that is typically underutilized in a dormitory room, does not protrude significantly into the sleeping area above the mattress, does not limit space around the bed for easy ingress and egress, is easily installed without tools, and it will not damage the bedpost.

BRIEF SUMMARY OF THE INVENTION

A shelf unit for attachment to the top of a bedpost for holding items thereon comprising: a shelf; and a bedpost interface.

The shelf unit occupies space that is typically underutilized in most dormitory room configurations and does not protrude significantly into the sleeping area above the mattress and does not protrude into a space that would otherwise be occupied by dormitory room furniture or limit space available for ingress and egress from the bed.

The shelf unit is easy to install on a bedpost and has padding to protect the bedpost from damage.

In one embodiment of the invention, the bedpost interface consists of a pin which mates with the vertical hole present in some bedposts.

In another embodiment of the invention, the bedpost interface consists of a pin and a bracket extending downward from the underside of the shelf aligned with at least one vertical face of the bedpost to prevent the shelf from rotating around the axis of the pin.

In another embodiment of the invention, the bedpost interface is a sleeve that slips over the top of the bedpost.

The shelf may have a rail along at least one of a side edge and a back edge of the shelf to prevent items held on the shelf from falling over the edge. This rail may have a gap to permit the passage of at least one of a cord and a cable that is attached to at least one item held on the shelf. The outward edge of the shelf may be rounded to reduce the chance of injury to the bed occupant.

BRIEF DESCRIPTION OF THE DRAWINGS

Preferred and alternative embodiments are described in detail below with reference to the following drawings.

In accordance with common practice, the various described features are not drawn to scale but are drawn to emphasize features relevant to the present invention. Like reference characters denote like elements throughout figures and text.

DETAILED DESCRIPTION OF THE INVENTION

The present invention relates to a shelf unit, which is removably attachable to the top of a vertical support post, for holding items thereon comprising: a shelf; and a vertical support post interface. The shelf has an upper surface to serve as a resting surface for holding items resting thereon and a lower surface which rests against the top face of the vertical support post to support the weight of the shelf unit and the items resting thereon. The lower surface also attaches to the vertical support post interface which extends downward from the underside of the shelf to serve as a mating fixture with the top of the vertical support post. The vertical support post interface prevents the shelf unit from tipping about the top face of the vertical support post and to prevent the shelf unit from easily rotating about the vertical axis of the vertical support post.

Attaching the shelf unit to the vertical support post comprises: aligning the vertical support post interface with the top of the vertical support post and lowering the shelf unit until the lower surface of the shelf rests upon the top face of the vertical support post.

Although the below vertical support post is described in relation to a bedpost, the invention can apply to any vertical support post.

Figure 1:
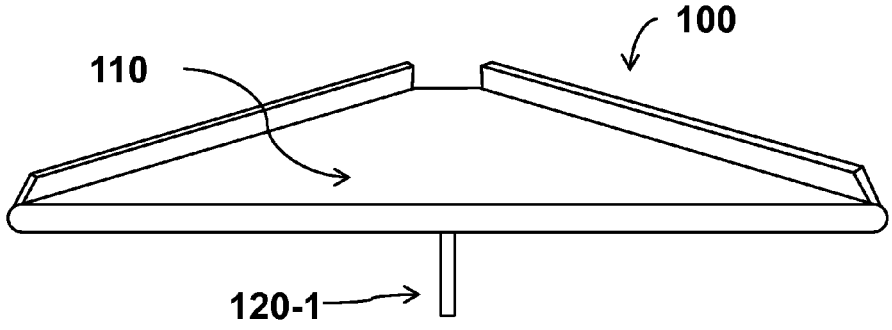
FIG. 1 is a perspective view of the shelf unit constructed in accordance with this invention showing the shelf and the pin configuration of the bedpost interface.
Figure 4:
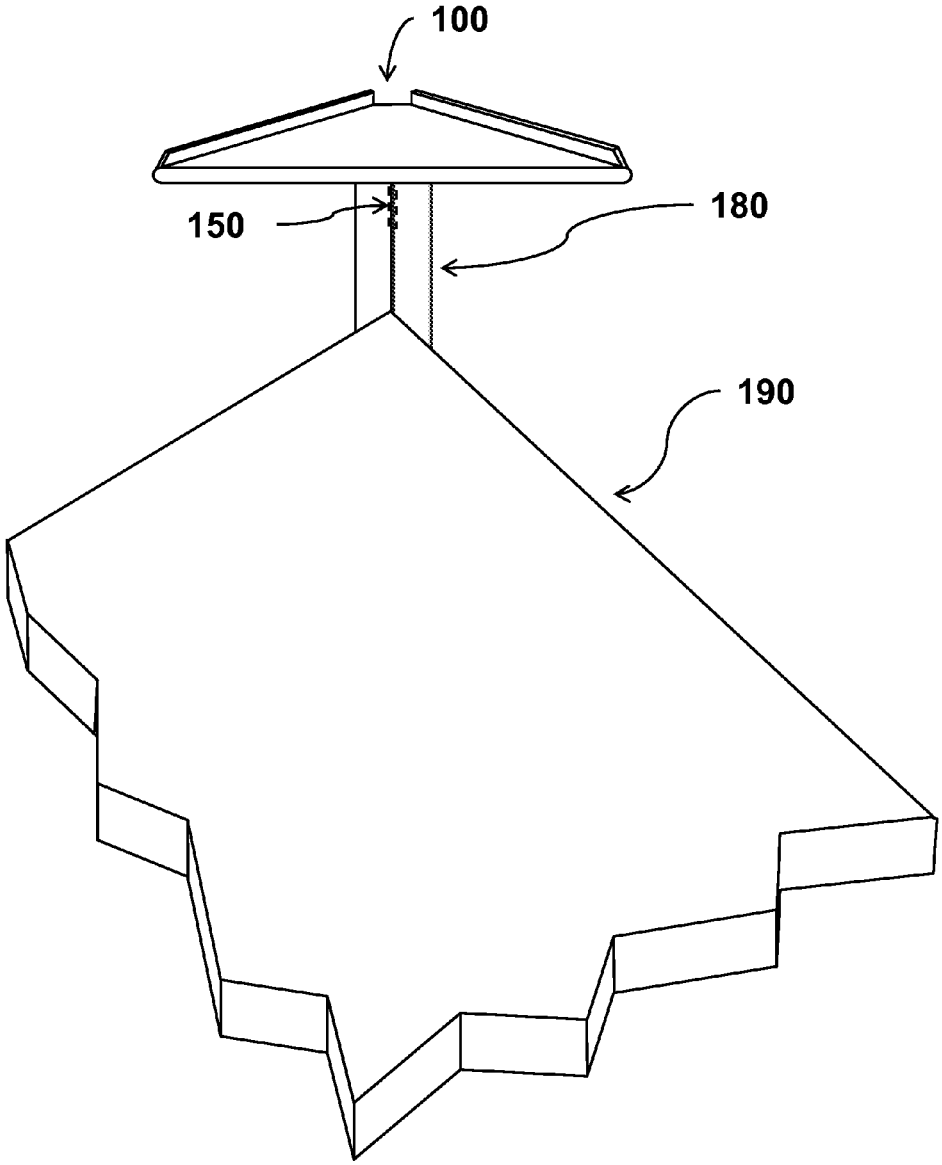
FIG. 4 is a perspective view from afar showing the shelf unit mounted to the bedpost of a bed with the pin bedpost interface configuration.

For the purpose of presentation, FIG. 1 is a perspective view of a shelf unit 100 constructed in accordance with this invention showing the shelf 110 and a bedpost interface 120-1 which consists of a pin affixed to the underside of shelf 110. As shown in FIG. 4 the pin 150 mates with a vertical hole present in many dormitory room bedposts 180. Bedpost 180 is shown located outside of the sleeping area above mattress 190. Shelf unit 100 is easily installed on bedpost 180 by aligning pin 150 with the vertical hole located in the top of bedpost 180 and lowering shelf unit 100 into place where the underside of the shelf unit 100 comes into contact with the top of bedpost 180. The portion of the pin which mates with the vertical hole in the bedpost is not affixed to the bedpost so that the pin can side into the vertical hole for installation and removal of the shelf unit.

Figure 2:
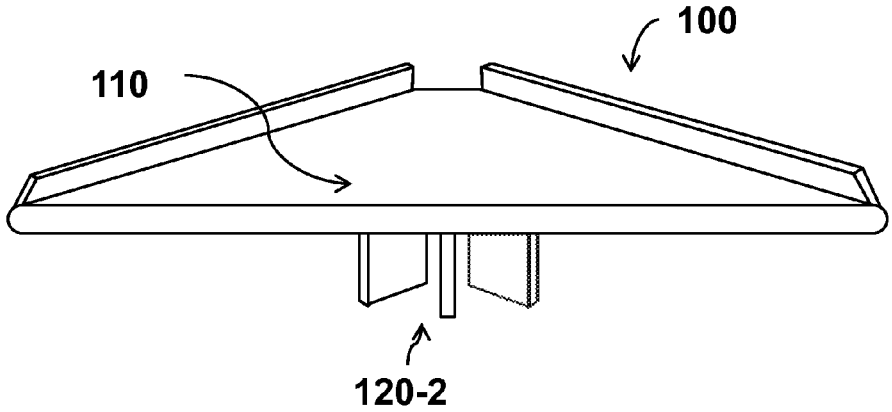
FIG. 2 is a perspective view of the shelf unit constructed in accordance with this invention showing the shelf and the pin and bracket configuration of the bedpost interface.
Figure 5:
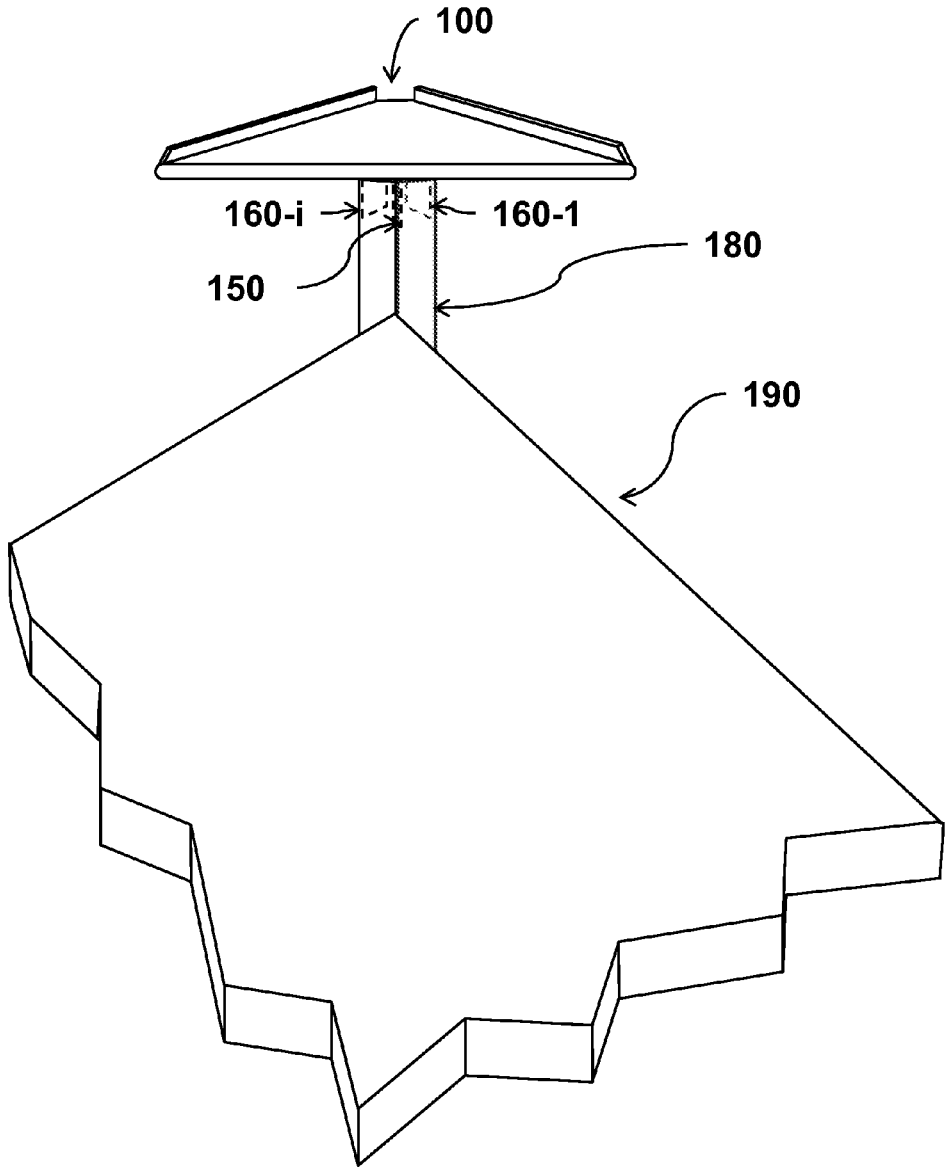
FIG. 5 is a perspective view from afar showing the shelf unit mounted to the bedpost of a bed with the pin and bracket bedpost interface configuration.
Figure 8:
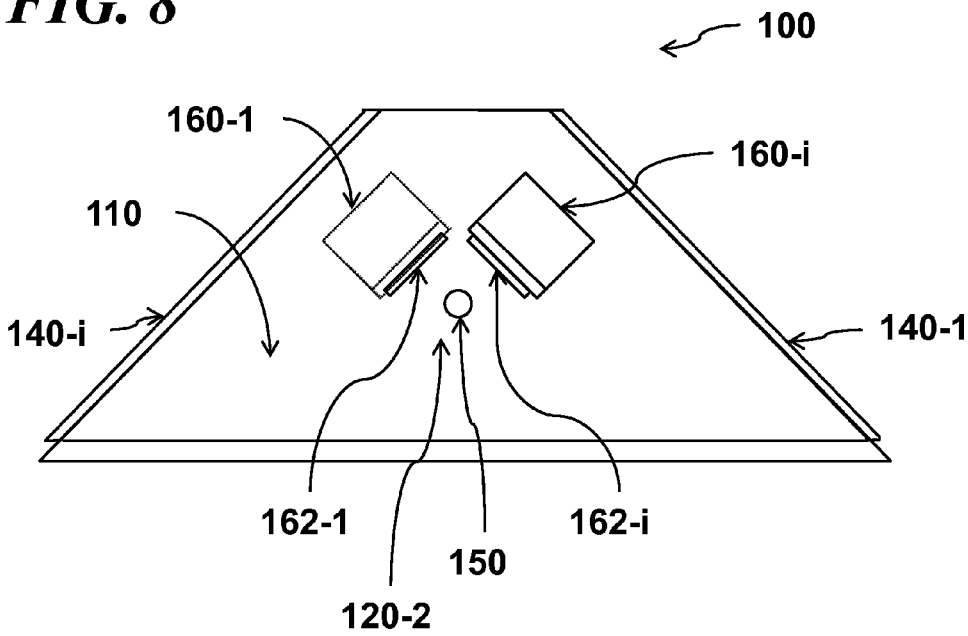
FIG. 8 is the bottom view of the shelf unit constructed in accordance with this invention showing the shelf and the pin and bracket configuration of the bedpost interface.

In another embodiment, FIG. 2 is a perspective view of a shelf unit constructed in accordance with this invention showing the shelf 110 and a bedpost interface 120-2 which consists of a pin and at least one bracket affixed to the underside of shelf 110. As shown in FIG. 5, pin 150 mates with a vertical hole present in many dormitory room bedposts 180 and the face of bracket **160-*i* fits snugly against the vertical face of bedpost 180 without being affixed to the vertical face of the bedpost so that the shelf unit can be removably attached to the bedpost. The points of contact between the face of brackets 160-*i* and the vertical face of the bedpost do not subtend an angle more than 180 degrees measured from the leftmost contact point and the rightmost contact point with the vertex of the angle located at the center of the pin as shown in FIG. 8. Bedpost 180 is shown located outside of the sleeping area above mattress 190. Shelf unit 100 is easily installed on bedpost 180 by aligning pin 150 with the vertical hole located in the top of bedpost 180, aligning the vertical face of bracket 160-*i* with the vertical face of bedpost 180 and lowering shelf unit 100 into place where the underside of the shelf unit 100 comes into contact with the top of bedpost 180**.

Figure 3:
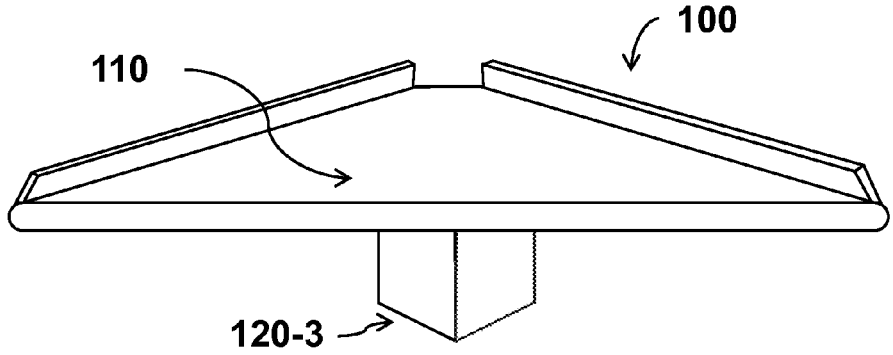
FIG. 3 is a perspective view of the shelf unit constructed in accordance with this invention showing the shelf and the sleeve configuration of the bedpost interface.
Figure 6:
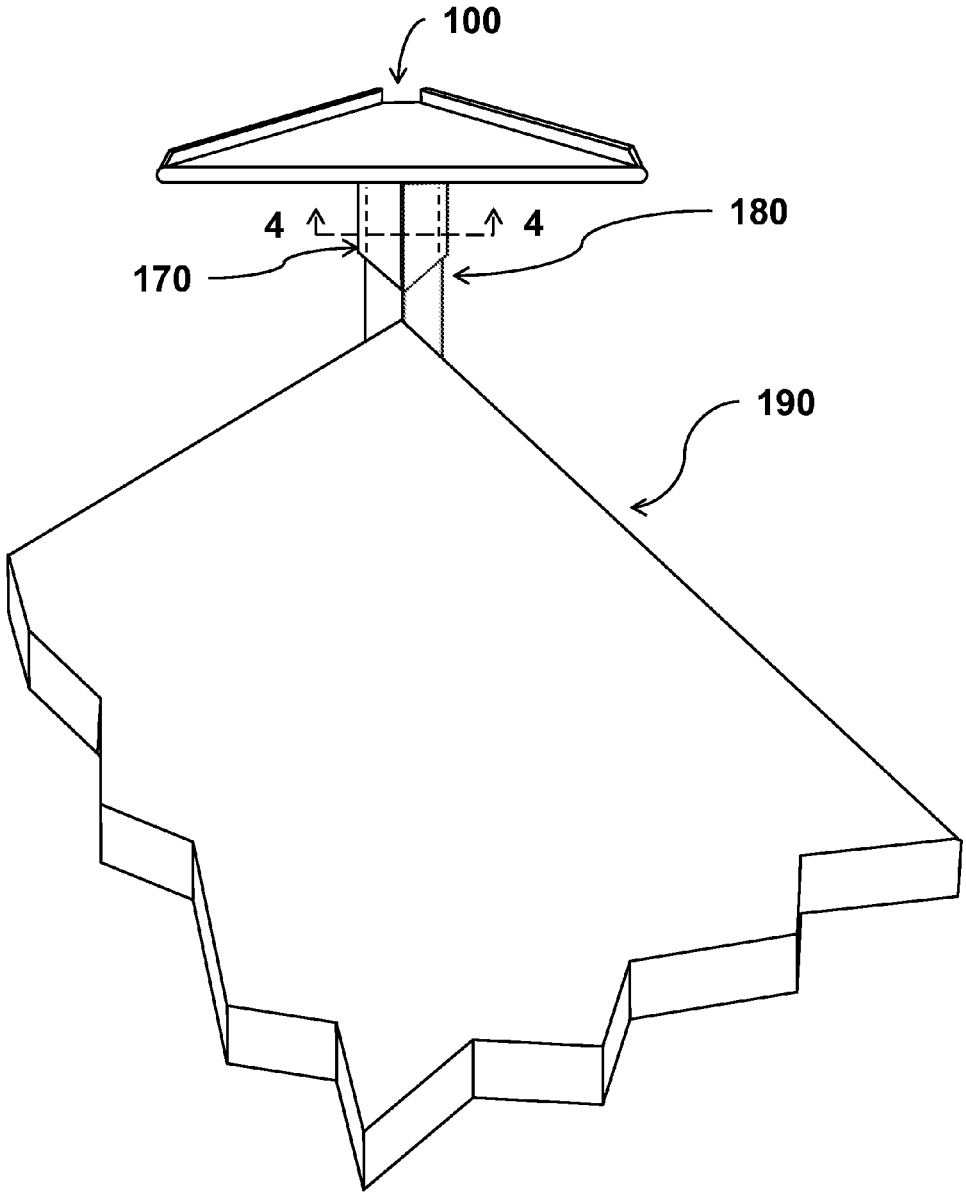
FIG. 6 is a perspective view from afar showing the shelf unit mounted to the bedpost of a bed with the sleeve bedpost interface configuration.

In yet another embodiment, FIG. 3 is a perspective view of a shelf unit constructed in accordance with this invention showing the shelf 110 and a bedpost interface 120-3 which consists of a sleeve affixed to the underside of shelf 110 only. As shown in FIG. 6, sleeve 170 fits over the top of the bedpost 180. Bedpost 180 is shown located outside of the sleeping area above mattress 190. Shelf unit 100 is easily installed on bedpost 180 by aligning the vertical faces of sleeve 170 with the vertical faces of bedpost 180 and lowering shelf unit 100 into place where the underside of the shelf unit 100 comes into contact with the top of bedpost 180.

Figure 7:
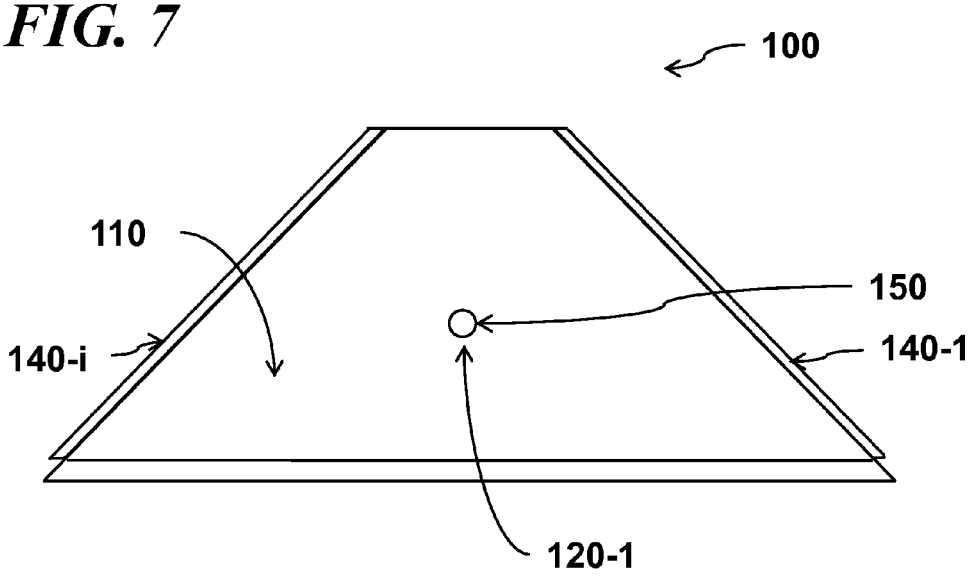
FIG. 7 is the bottom view of the shelf unit constructed in accordance with this invention showing the shelf and the pin configuration of the bedpost interface.

FIG. 7 shows the pin 150 configuration of the bedpost interface 120-1 attached to the underside of the shelf 110. The diameter of pin 150 should be chosen such that pin 150 has a snug fit in the vertical hole of bedpost 180 to prevent the shelf 110 from rotating easily about the axis formed by pin 150.

In one embodiment with a wooden shelf 110, pin 150 is composed of a wooden dowel rod which is at least one of glued and affixed by other binding means to shelf 110. A vertical hole, with a centerline perpendicular to the bottom of the shelf, with a diameter equal to that of the wooden dowel rod may be drilled into the underside of, but not through, shelf 110 to provide a stronger mechanical interface between the pin 150 and shelf 110. In another embodiment with a wooden shelf 110, pin 150 is a metal rod which is affixed to the shelf 110 in a manner similar to a wooden dowel rod pin 150. In yet another embodiment with a wooden shelf 110, pin 150 is a threaded metal rod which can be affixed to the underside of shelf 110 by screwing the metal rod into shelf 110.

In yet another embodiment, shelf 110 and pin 150 (cylindrical protrusion) is molded of plastic in a one piece, monolithic assembly. In yet another embodiment, shelf 110 is molded of plastic where pin 150 is a metal rod molded into shelf 110. It should be clear to anyone skilled in the art that there are many combinations of materials and manufacturing processes to implement this invention.

FIG. 8 shows the pin 150 and bracket **160-*i* configuration of the bedpost interface 120-2 attached to the underside of the shelf 110. The diameter of pin 150 should be chosen such that pin 150 slides easily into the vertical hole of bedpost 180 to facilitate installation of the shelf unit 100 onto bedpost 180. Bracket 160-*i* has two outward facing faces angled 90 degrees relative to each other. One face of bracket 160-*i* is affixed to the underside of shelf 110. The other face of bracket 160-*i* is oriented such that it will snugly abut at least one vertical face of bedpost 180 when the shelf unit 100 is installed over bedpost 180**.

In one embodiment with a wooden shelf 110, pin 150 is composed of a wooden dowel rod which is at least one of glued and affixed by other binding means to shelf 110. A vertical hole with a diameter equal to that of the wooden dowel rod may be drilled into the underside of, but not through, shelf 110 to provide a stronger mechanical interface between the pin 150 and shelf 110. In this embodiment, at least one bracket **160-*i* is a piece of wooden molding affixed by at least one of glue and nails. In another embodiment with a wooden shelf 110, pin 150 is a metal rod which is affixed to the shelf 110 in a manner similar to a wooden dowel rod pin 150. In another embodiment, at least one bracket 160-*i* is at least one of a metal bracket and a plastic bracket with holes through which wood screws are utilized to affix the bracket 160-*i* to the underside of shelf 110. In yet another embodiment with a wooden shelf 110, pin 150 is a threaded metal rod which can be affixed to the underside of shelf 110 by screwing the metal rod into shelf 110**.

In yet another embodiment, shelf 110, pin 150, and at least one bracket **160-*i*** is molded of plastic in a one piece assembly.

In yet another embodiment, shelf 110 and at least one of bracket **160-*i* is molded of plastic in a one piece assembly and pin 150 is a metal rod molded into shelf 110**. It should be clear to anyone skilled in the art that there are many combinations of materials and manufacturing processes to implement this invention.

In one embodiment, protective pad material **162-*i* is affixed to the face of bracket 160-*i*, which will abut the vertical face of bedpost 180 when shelf unit 100 is installed over bedpost 180, to prevent damage to bedpost 180**.

Figure 9:
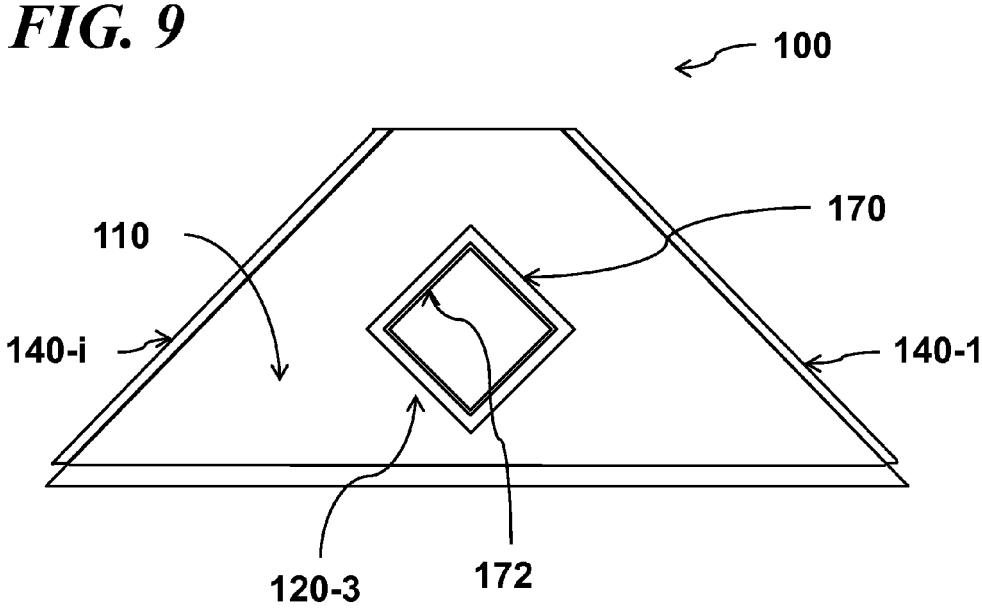
FIG. 9 is the bottom view of the shelf unit constructed in accordance with this invention showing the shelf and sleeve configuration of the bedpost interface.
Figure 10:
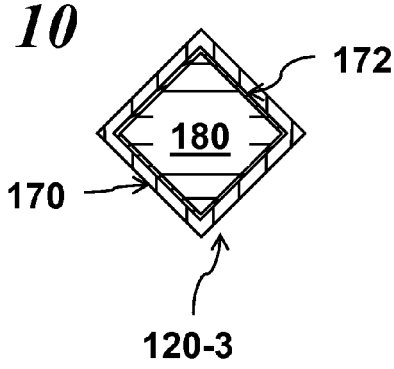
FIG. 10 is a cross section view of the sleeve configuration of the bed post interface installed over a bedpost.

FIG. 9 shows the socket 170 configuration of the bedpost interface 120-3 attached to the underside of the shelf 110. FIG. 10 shows that the inner horizontal cross section of bedpost interface 170 with protective pad material 172 affixed is no smaller than the horizontal cross section of the top portion of bedpost 180 covered by bedpost interface 120-3 when shelf unit 110 is installed over bedpost 180.

In one embodiment, sleeve 170 is fabricated of wood and affixed to the underside of shelf 110 by one of at least glue, nails, and screws. In another embodiment, bedpost interface 170 is at least one of a metallic fixture and molded plastic and is affixed to the bottom of shelf 110 by at least one of glue, screws and nails.

In yet another embodiment, shelf 110 and sleeve 170 is molded of plastic in a one piece assembly. It should be clear to anyone skilled in the art that there are many combinations of materials and manufacturing processes to implement this invention.

In one embodiment, protective pad material 172 is affixed to the inner face of sleeve 170 to prevent damage to bedpost 180 when shelf unit 100 is installed over bedpost 180.

Figure 11:
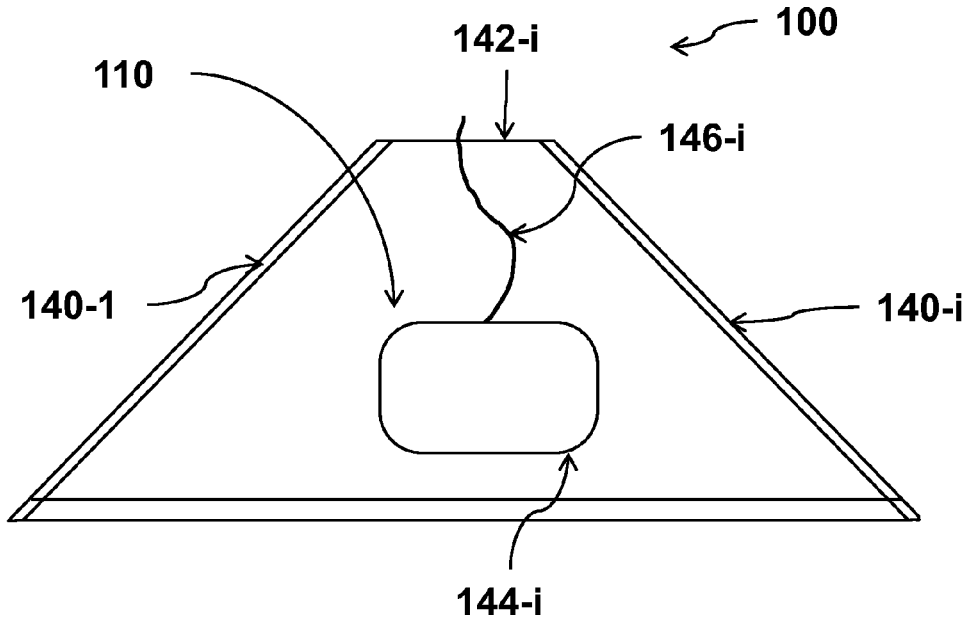
FIG. 11 is a top view of the shelf shown with one item held by the shelf with a cord attached.

FIG. 11 shows shelf unit 100 with a shelf 110 for holding items thereon. Rail 140-*i* positioned on at least one of a side edge and back edge of shelf 110 which rail serves to prevent items held on the planar surface from falling over the edge. In one embodiment, there is at least one gap 142-*i* between rails 140-*i* to permit the passage of at least one of a cord and a cable 146-*i* that is connected to at least one of item 144-*i* held by shelf 110.

Figure 12:
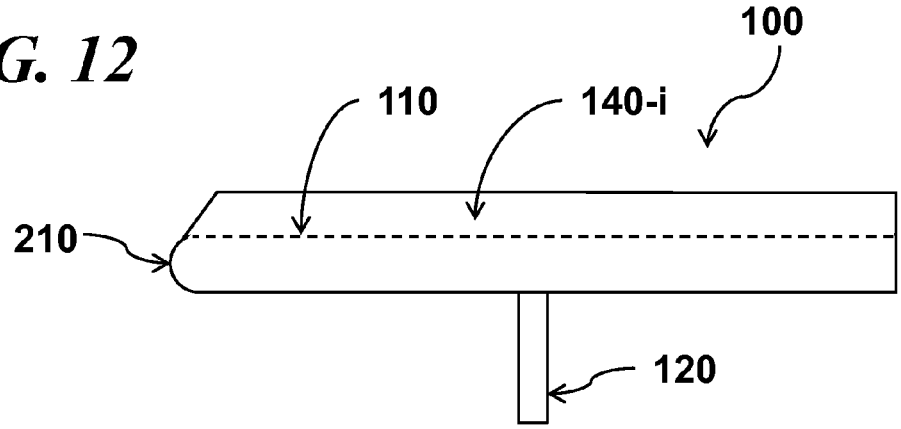
FIG. 12 is a side view of the apparatus showing the rounding of the outward edge.

FIG. 12 shows that the outward facing edge 210 of shelf 110 is rounded to reduce the likelihood of injury to the bed occupant.

While the preferred embodiment of the invention has been illustrated and described, as noted above, many changes can be made without departing from the spirit and scope of the invention. Accordingly, the scope of the invention is not limited by the disclosure of the preferred embodiment. Instead, the inventions should be determined entirely by reference to the claims that follow.

The embodiments of the invention in which an exclusive property or privilege is claimed are defined as follows:

1. An apparatus in combination with a vertical support post having a polygonal cross-section, the apparatus mounted atop the vertical support post for holding items thereon, the apparatus comprising:

a shelf having a top surface for providing a resting surface for items, a bottom surface, and a circular hole extending through the bottom surface of the shelf without extending through the top surface, the circular hole having a centerline perpendicular to the bottom surface;

a vertical support post interface extending downward from the bottom surface of the shelf to serve as a mating fixture with a top portion of the vertical support post such that the bottom surface of the shelf rests directly upon a top face of the vertical support post, the vertical support post interface consisting of:

a pin, wherein a portion of the pin is affixed within the circular hole in the shelf, and a remaining portion of the pin extends downward from the circular hole and is inserted within a vertical hole in the vertical support post, wherein the remaining portion of the pin is non-threaded such that it creates a snug fit with the vertical hole in order to prevent the apparatus from tipping; and two brackets, each bracket comprising a horizontally oriented flange having a horizontal face affixed to the bottom surface of the shelf, and a vertically oriented flange extending downward from the horizontally oriented flange and having a vertical face abutting against a respective face of the vertical support post to prevent the apparatus from rotating around the vertical support post, wherein the respective faces of the vertical support post are adjacent to each other, and wherein the vertical support post interface allows the apparatus to slide over the vertical support post for installation and removal; and wherein the two brackets are spaced from the pin and oriented such that the vertical faces abutting against the vertical support post form an angle of less than 180 degrees and correspond to the polygonal cross-section of the vertical support post, with the pin centrally located and defining a vertex between the vertically oriented flanges of the two brackets.

2. The apparatus of claim 1, wherein at least one of the vertical faces of the vertically oriented flanges of the two brackets has a protective pad to prevent damage to the vertical support post.

3. The apparatus of claim 1, wherein the vertical support post is a bedpost.

* * * * *